US006899072B2

(12) United States Patent
Spitler

(10) Patent No.: US 6,899,072 B2
(45) Date of Patent: May 31, 2005

(54) VACUUM-OPERATED CHOKE SYSTEM AND METHOD

(75) Inventor: Charles R. Spitler, Haw River, NC (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/402,615

(22) Filed: Mar. 28, 2003

(65) Prior Publication Data

US 2004/0187824 A1 Sep. 30, 2004

(51) Int. Cl.[7] ..... F02N 17/00
(52) U.S. Cl. ..... 123/179.16; 261/64.6
(58) Field of Search ..... 123/179.16, 179.18, 123/179.24; 261/64.4, 64.6, 35

(56) References Cited

U.S. PATENT DOCUMENTS

| | | | | | |
|---|---|---|---|---|---|
| 3,928,511 | A | | 12/1975 | Atsumi et al | |
| 4,096,211 | A | * | 6/1978 | Rameau | 261/23.2 |
| 4,202,302 | A | * | 5/1980 | Tamura | 261/39.3 |
| 4,271,094 | A | * | 6/1981 | Walters et al. | 261/39.3 |
| 4,298,549 | A | | 11/1981 | Woodworth | |
| 4,348,996 | A | | 9/1982 | Morozumi | |
| 4,793,951 | A | * | 12/1988 | Scott | 261/35 |
| 4,820,454 | A | | 4/1989 | Scott et al. | |
| 4,926,808 | A | * | 5/1990 | Kandler | 123/179.11 |
| 4,951,926 | A | | 8/1990 | O'Shea et al. | |
| 5,194,186 | A | | 3/1993 | Edlund | |
| 5,891,369 | A | * | 4/1999 | Tuggle et al. | 261/35 |
| 6,079,697 | A | * | 6/2000 | Tuggle et al. | 261/35 |
| 6,561,495 | B2 | * | 5/2003 | Woody | 261/37 |

* cited by examiner

*Primary Examiner*—Mahmoud Gimie
(74) *Attorney, Agent, or Firm*—Jenkins, Wilson & Taylor, P.A.

(57) ABSTRACT

A vacuum-operated choke system for use with an internal combustion engine and method of using the same including a vacuum actuator for moving an actuating arm for connection to a choke valve of an internal combustion engine from a first position to a second position, an air valve in communication with the vacuum actuator, and a vacuum mechanism in communication with the vacuum actuator and the air valve for causing air to discharge through the air valve whereby the vacuum actuator can move the actuating arm from the first position to the second position and whereby the air valve is operable to allow air to enter the air valve whereby the vacuum actuator can move the actuating arm from the second position to the first position. The choke system can include a manifold defining at least one air inlet and one air outlet communicating with the vacuum actuator for passage of air into and out of, respectively, the vacuum actuator and can further comprise an orifice selector plate attached to the manifold, wherein the orifice selector plate can be positioned to cover all of the air inlets but one to control airflow through the manifold.

17 Claims, 6 Drawing Sheets

10
16
A
VA
12
VM 10
16
26
A
VA
12
VM 10
16
A
VA
12
VM 10
16
A
VA
12
VM 10
16
28
A
VA
12
VM

VACUUM-OPERATED CHOKE SYSTEM AND METHOD

TECHNICAL FIELD

The present invention generally relates to the field of chokes or starting mechanisms for engines. More specifically, the present invention relates to a vacuum-operated choke system and method particularly suitable for internal combustion engines.

BACKGROUND ART

Starting internal combustion engines usually requires the use of a choke system of some type. Choke systems typically perform the fuel mixture adjustments necessary to start a cold engine. When the fuel-air mixture is too cold, the engine will usually not start properly, or will start and stall out periodically. When engaged (closed), the choke system usually causes the fuel-air mixture to be increased, or "enriched" as the choke is a special valve placed at the mouth of the carburetor for partially blocking off the entering air. When the choke system is in a closed position, the fuel system of the cold engine has a very high restriction on the air intake. The restriction of the air intake forms a vacuum communicating with the fuel line, drawing more fuel into the engine via the carburetor from the fuel bowl or tank. This rich fuel mixture burns even at cool temperatures, allowing the engine to start and warm up. As the engine begins to warm, a certain amount of air is necessary to keep the engine running. If the choke is not opened and air does not begin to enter the fuel system, the engine will likely run for only a short period of time and then will stall. This start and stall process is commonly known as a "false start". The reason for the "false start" is that as the speed of the engine increases, the engine draws in more fuel. With the choke in the closed position, however, the amount of airflow entering the engine is not increased. Thus a proper mixture of air and fuel is not achieved and the engine will subsequently stall. Moreover, if the engine does not start immediately, a substantial amount of fuel is sucked into the engine, via the carburetor, causing the engine to become flooded, further hampering the starting procedure of the engine.

Older choke systems typically focus on manual choke valves in which the user of the engine would manually close the choke when starting the engine. With manual choke valves, the user must open the choke valve quickly after the engine begins running to avoid the engine false starting. A further problem of manual choke valves is that a user often does not open the valve fully, resulting in a rich fuel mixture. This rich fuel mixture causes carbon to form in the combustion chambers and on the spark plugs. To solve these problems, automatic choke valves were developed to automatically open the choke valve based on engine heat, speed, vibrations, or vacuums.

Several automatic choke valves have been developed that rely on engine temperature. One such choke valve can be found in U.S. Pat. No. 4,348,996 to Morozumi. This type of choke valve is run by a thermostat that is controlled by exhaust heat. When an engine is cold, the valve will be closed for starting. As the engine warms, the exhaust heat will gradually open the choke valve. An automatic choke based on engine temperature depends on a thermostatic coil spring unwinding as heat is supplied. As the engine warms up, manifold heat is transmitted to the choke housing causing the spiral bimetal element to relax, thus opening the valve.

Other automatic choke valves have been developed that will open the choke valve based on engine vibrations or engine speed. U.S. Pat. No. 4,820,454 to Scott et al. discloses a choke assembly that utilizes the vibration of the internal combustion engine during start up for enabling air to enter into the carburetor of the engine at startup. The invention disclosed in Scott et al. describes an inertia valve that is resiliently biased in the bore of an engine that is responsive to vibration of the engine for providing a controlled amount of combustion air into the carburetor of the engine. U.S. Pat. No. 4,298,549 to Woodworth discloses a choke valve that is biased closed with a spring and is then opened based on engine speed vacuum.

A further type of automatic choke valve developed is based upon the vacuum created within an engine compartment as an engine is started and begins to run. U.S. Pat. No. 3,928,511 to Atsumi et al. discloses a vacuum-operated choke valve for the air intake passage of an internal combustion engine. When a user desires to start a cold engine, he pulls a manual knob, which through various linkages closes the choke valve. When the engine starts, the vacuum from the engine moves the connecting rod to the right, thereby opening the choke valve. The choke valve is biased by a spring to the actuator so that the force of the spring increases as the actuator is moved beyond the position corresponding to the closed position of the choke valve.

U.S. Pat. No. 4,951,926 to O'Shea et al. discloses a choke system in which the choke valve is biased in a direction to block the passage of air between the air inlet and the air outlet of the choke housing. The choke valve is responsive to engine vacuum during starting of the engine to move the valve in a direction against the biasing element to permit air to enter the carburetor from outside the housing. Finally, U.S. Pat. No. 5,194,186 to Edlund discloses a carburetor provided with an elastic choke valve that will yield to the air stream created by an engine vacuum and furnish a fuel-air mixture to the engine. The choke valve of Edlund begins in a closed position and when the engine is started and a vacuum in the engine compartment is created, there will be a force of air to pass around the choke valve. The elastomer choke valve is permitted to bend to a partially open position until the user can manually open the choke to a fully opened position.

Despite the existence of automatic choke valves based upon different engine operating parameters, it is desirable to provide a novel choke system and method that can be vacuum-operated and which overcomes disadvantages of the prior art choke systems.

SUMMARY

A choke system for use with an internal combustion engine is provided having a vacuum actuator for moving an actuating arm connected to a choke valve located on the carburetor of an internal combustion engine from a first position to a second position. An air valve is provided in communication with the vacuum actuator, and a vacuum mechanism is provided in communication with the vacuum actuator and the air valve for causing air to discharge through the air valve. In this manner, the vacuum actuator can move the actuating arm from the first position to the second position, and the air valve is operable to allow air to enter the air valve so that the vacuum actuator can move the actuating arm from the second position back to the first position.

The air valve of the choke system of the present invention can be an adjustable check valve for adjustment of the airflow exiting and entering the system over a predetermined amount of time. Furthermore, the vacuum mechanism of the present invention can include a primer bulb or similar mechanism wherein the vacuum mechanism can be actuated, such as by compression or other similar technique, to causes air to discharge through the air valve whereby the vacuum actuator can move the actuating arm from the first position to the second position. The choke system of the present invention can control the actuating arm connected to a choke valve such that movement of the actuating arm can open and close the choke valve in a controllable fashion. The choke valve can be an unbiased choke valve.

Another embodiment of the present invention describes a choke system for use with an internal combustion engine having a vacuum actuator for moving an actuating arm for connection to a choke valve of an internal combustion engine from a first position to a second position and a manifold in communication with the vacuum actuator. The manifold can define one or more air passages, such as an air inlet and an air outlet, communicating with the vacuum actuator for passage of air into and out of, respectively, the vacuum actuator. A vacuum mechanism is provided and is in communication with the vacuum actuator for forcing air out of the air outlet to at least substantially create a vacuum within the vacuum actuator. The vacuum within the vacuum actuator allows the vacuum actuator to move the actuating arm from the first position to the second position, and air can then enter the air inlet whereby the vacuum actuator can then move the actuating arm from the second position back to the first position. Where the manifold defines a plurality of air inlets, an orifice selector plate can be attached to the manifold and positioned to desirably cover all of the manifold air inlets but one to control airflow through the manifold.

A method for operating a choke system of an internal combustion engine is also provided including the initial step of operating a vacuum mechanism to cause air to discharge through an air valve in communication with the vacuum actuator. This air discharge at least substantially creates a vacuum to cause the vacuum actuator to move an associated actuating arm from a first position to a second position. The actuating arm can be connected to a choke valve of an internal combustion engine, such that the choke valve would be in a closed position when the actuating arm is the second position. Once the actuating arm is in the second position, an air valve in communication with the vacuum actuator can controllably allow air to enter the air valve such that the vacuum actuator moves the actuating arm from the second position back to the first position. This method can include setting the air valve to controllably allow air to enter the air valve such that movement of the actuating arm from the second position back to the first position requires a predetermined amount of time.

A method for operating a choke system of an internal combustion engine is also provided including the initial step of providing a vacuum-operated choke system including a vacuum actuator for moving an actuating arm for connection to a choke valve of an internal combustion engine from a first position to a second position, a manifold in communication with the vacuum actuator, the manifold defining at least one air inlet and one air outlet communicating with the vacuum actuator for passage of air into and out of, respectively, the vacuum actuator, and a vacuum mechanism in communication with the vacuum actuator for forcing air out of the air outlet to at least substantially create a vacuum within the vacuum actuator. The method further includes the steps of operating the vacuum mechanism to cause air to discharge through the air outlet to move the actuating arm from the first position to the second position and controllably allowing air to enter the air inlet such that the vacuum actuator moves the actuating arm from the second position back to the first position.

Therefore, it is an object of the present invention to provide a novel vacuum-operated choke system and method particularly suitable for use with internal combustion engines.

An object of the invention having been stated hereinabove, and which is achieved in whole or in part by the present invention, this and other objects will become evident as the description proceeds, when taken in connection with the accompanying drawings as best described hereinbelow.

BRIEF DESCRIPTION OF THE DRAWINGS

Exemplary embodiments of the invention will now be explained with reference to the accompanying drawings, of which.

DETAILED DESCRIPTION OF THE INVENTION

Figure 1:
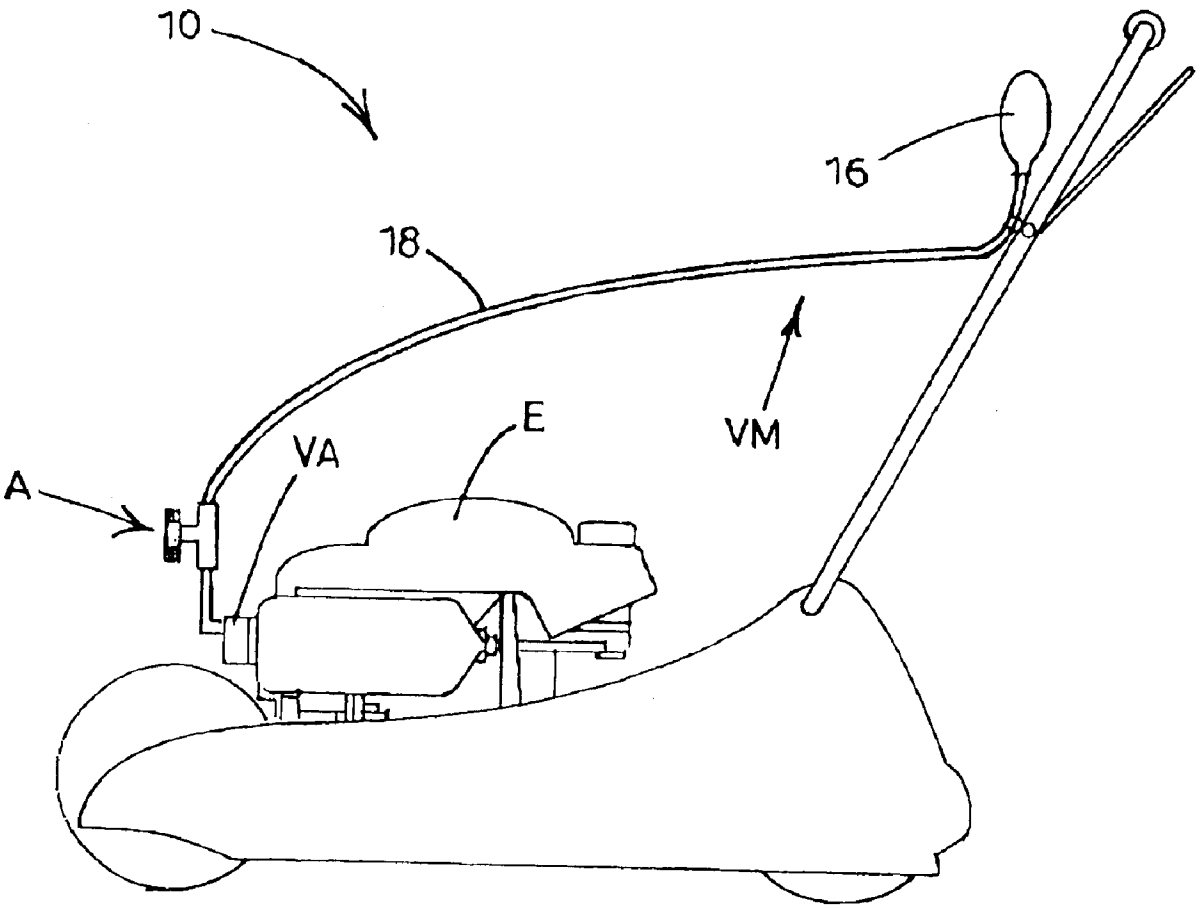
FIG. 1 is a schematic sectional side view of a grass mowing machine with an engine employing an embodiment of the vacuum-operated choke system.
Figure 2:
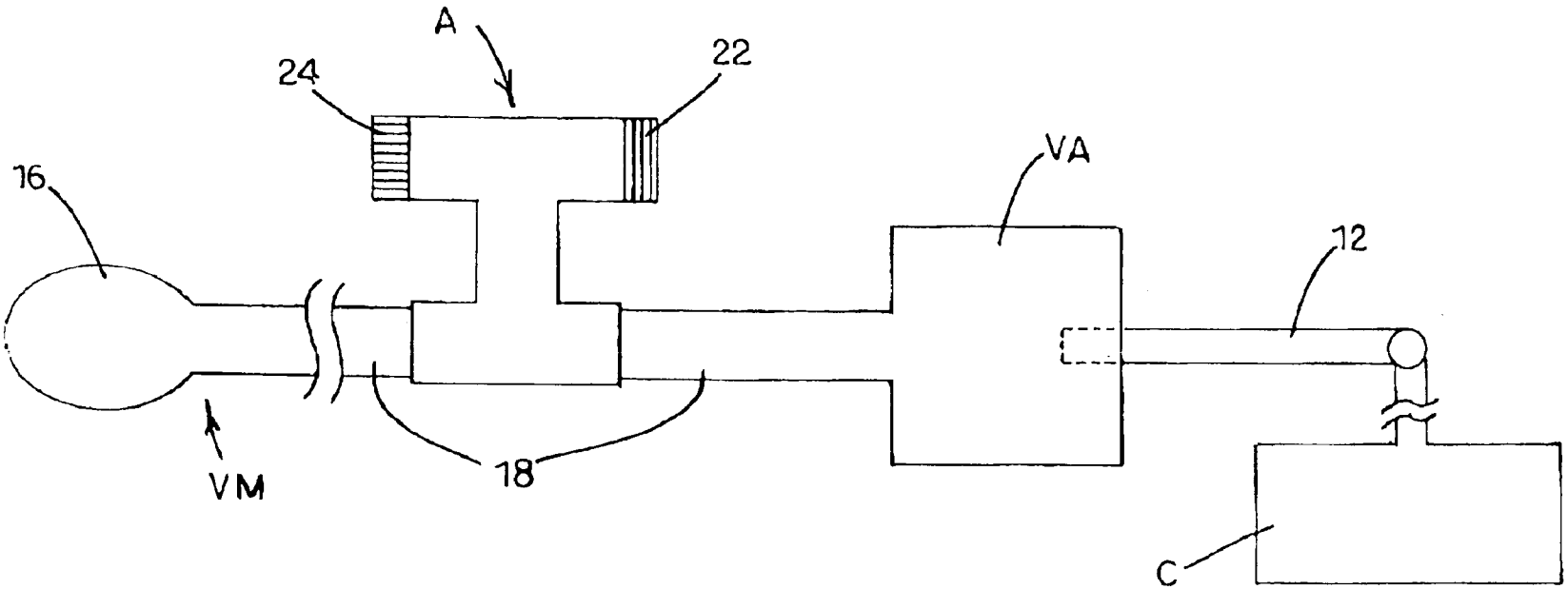
FIG. 2 is a schematic side view of an embodiment of the vacuum-operated choke system.
Figure 3A:
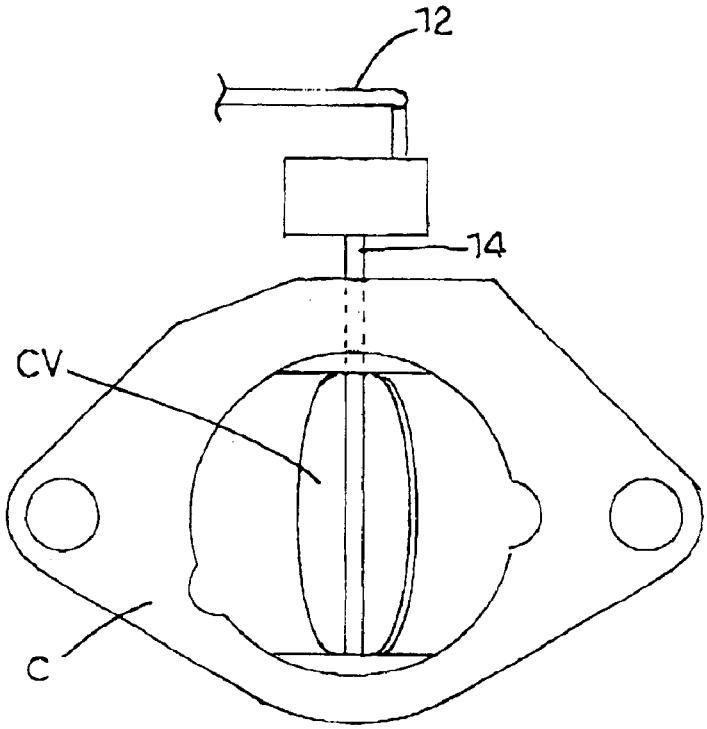
FIGS. 3A–3B are front views of an open carburetor illustrating operation of a choke valve for connection to a vacuum-operated choke system.
Figure 3B:
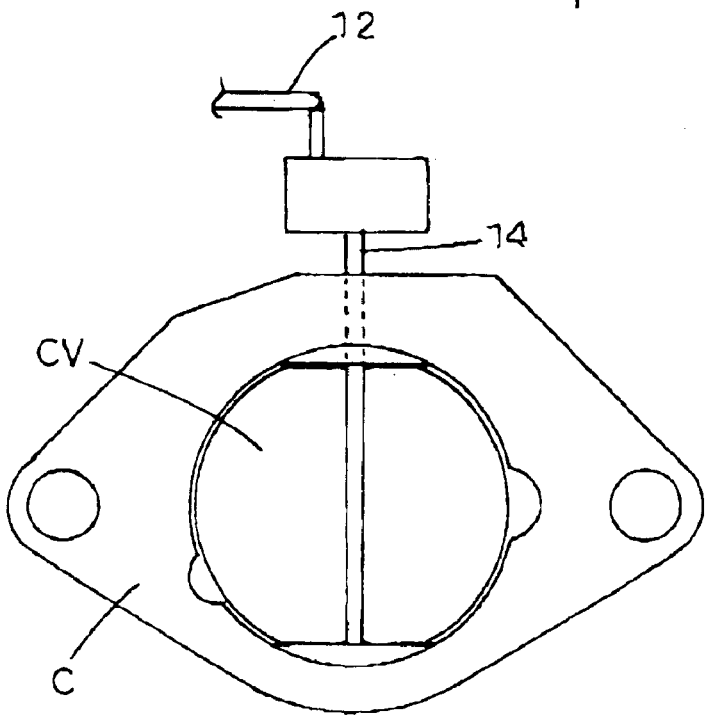

Referring to FIGS. 1, 2, 3A and 3B of the drawings, a vacuum-operated choke system, generally designated 10, according to an embodiment of the present invention is illustrated. Choke system 10 of the present invention can be used with an internal combustion engine E, such as those found on various lawn equipment and other motor-operated vehicles and tools. The intake passage, which typically is a carburetor C, of internal combustion engine E is provided with a choke valve CV which can be fixed on a choke shaft 14 mounted to move so that choke valve CV can be moved between a first open position (FIG. 3A) and a second closed position (FIG. 3B). Choke valve CV is in communication with the air intake of carburetor C and can be unbiased in its position within carburetor C. An actuator arm 12 can link to choke valve CV and can move responsive to a vacuum produced in accordance with the present invention, as further described hereinbelow.

Choke valve CV, through actuator arm 12, is in communication with a vacuum actuator VA or other suitable mechanism as known in the art to respond to a vacuum producing source to create movement in actuator arm 12. Vacuum actuator VA is in turn in communication with an air valve A through tubing 18. Air valve A can comprise an adjustable check valve or any other suitable air valve known to those skilled in the art to allow air to enter and exit the choke system in a controlled manner. As shown in FIG. 2, an air valve A in a preferred embodiment comprises an exhaust port 22, which can be a check valve, in which the entry air flow can be adjusted by a needle adjuster 24 to control movement of actuating arm 12 over a predetermined amount of time.

A vacuum mechanism, generally designated VM, for creating a vacuum for controlling operation of actuating arm 12 is in communication with vacuum actuator VA and air valve A. Vacuum mechanism VM is shown as including a primer bulb 16 attached to air valve A through tubing 18. It is envisioned according to this invention, however, that vacuum mechanism VM could comprise any other suitable vacuum system known to those skilled in the art to produce a suitable vacuum.

FIGS. 3A–3B illustrate opening and closing of choke valve CV within the throat of the carburetor C in response to the vacuum produced. FIG. 3A illustrates carburetor C with choke valve CV in a first open position where choke valve CV is attached to choke shaft 14 which in turn is connected to actuator arm 12 shown in an open position to the right. In response to the vacuum produced by the present invention, actuator arm 12 moves to the left as shown in FIG. 3B thus closing at least substantially choke valve CV.

Figures 4A, 4B, 4C, 4D, 4E:
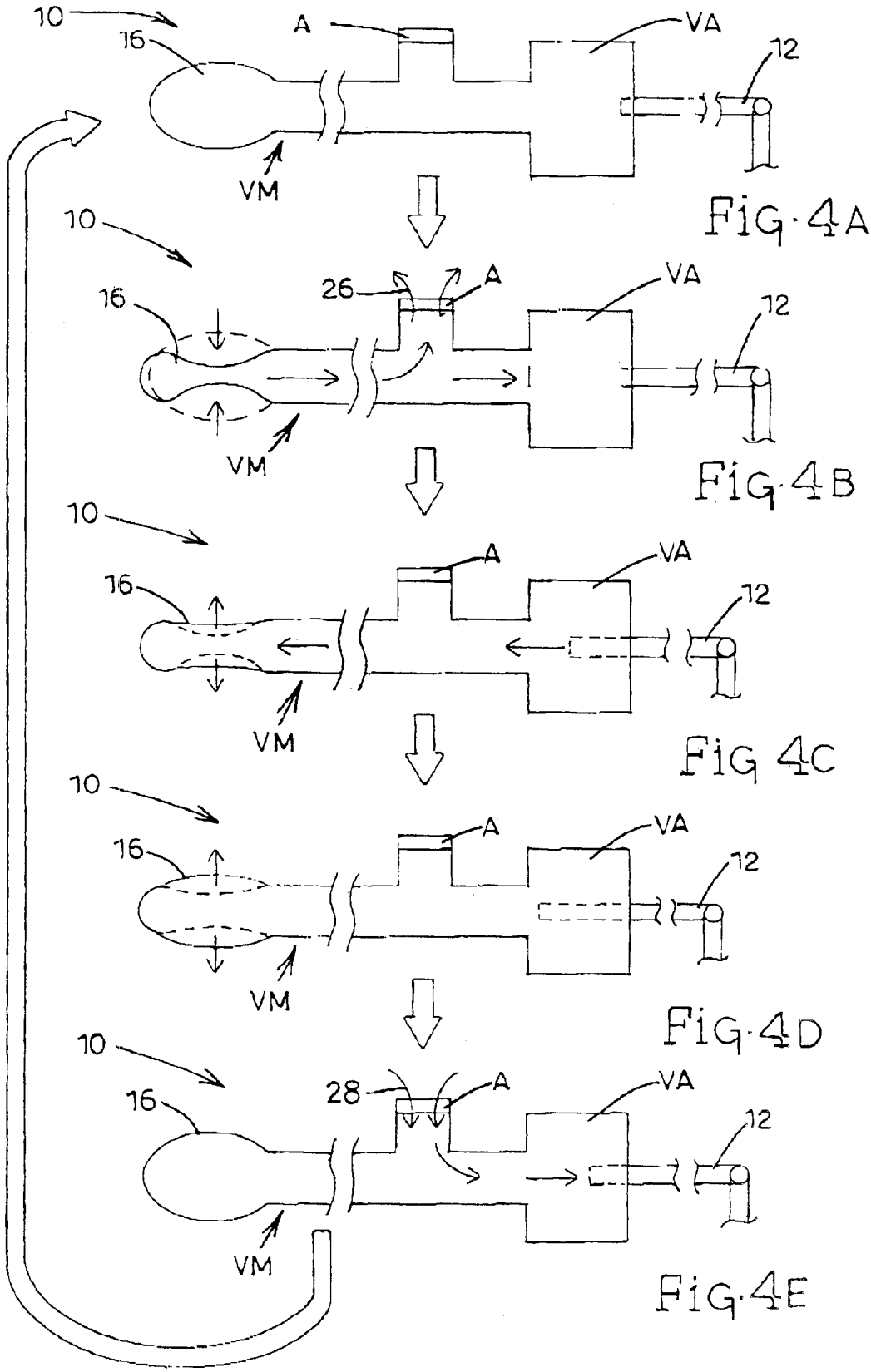
FIGS. 4A–4E are schematic diagrams illustrating operation of a vacuum-operated choke system.

FIGS. 4A–4E are schematic diagrams illustrating operation of the embodiment of the invention shown in FIGS. 1 and 2. For purposes of illustration, air valve A is shown as a single-ended air valve and vacuum mechanism VM includes primer bulb 16. As shown in FIG. 4A, actuator arm 12 is in a first open position, as it can be in from previous operation of the engine. When an operator desires to start a cold engine, the operator can operate vacuum mechanism VM, which involves compressing primer bulb 16 as shown in FIG. 4B, which forces air contained within the system out of air valve A as exiting air 26. After primer bulb 16 is fully compressed, suction pressure in the system, created by primer bulb 16 desiring to return to a normal position, forces actuator arm 12 to move toward the vacuum, thus closing choke valve CV. Once actuator arm 12 reaches a fully closed, second position as shown in FIG. 4D, primer bulb 16 has also reached its initial expanded position while the vacuum is still present in the system due to air displaced by actuator arm 12 moving into the system. In order to equalize this vacuum, backflow air 28 enters the system through air valve A, which can be an adjustable check valve, at a designated rate. As this air enters air valve A and tubing 18, the vacuum pressure within the system will release thus allowing actuator arm 12 to slowly return to its first open position, which in turn slowly opens choke valve CV. Once actuator arm 12 returns to its first position, as shown in FIG. 4A, the system is at equilibrium and choke valve CV will be in its fully open position.

Air valve A can be manually adjusted by a user, such as by a needle adjusted check valve, to set a certain entry airflow rate and thus enabling the user to adjust the speed in which the choke valve opens. This flow rate can be adjusted as desired so that choke valve CV opens in a controlled fashion over a predetermined amount of time. For example, it can be set to open over a time period of 8–10 seconds with a cold engine from when primer bulb 16 is fully compressed and the vacuum is first created, causing choke valve CV to close, to when choke valve CV returns to its normal open position and the vacuum in the system is alleviated.

Figure 5:
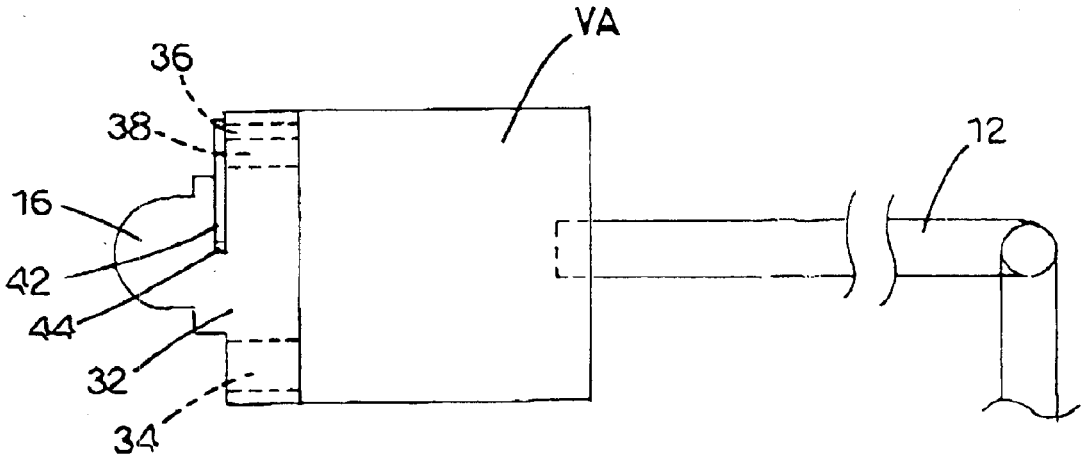
FIG. 5 is a schematic side view of an embodiment of the vacuum-operated choke system utilizing a manifold.
Figure 6:
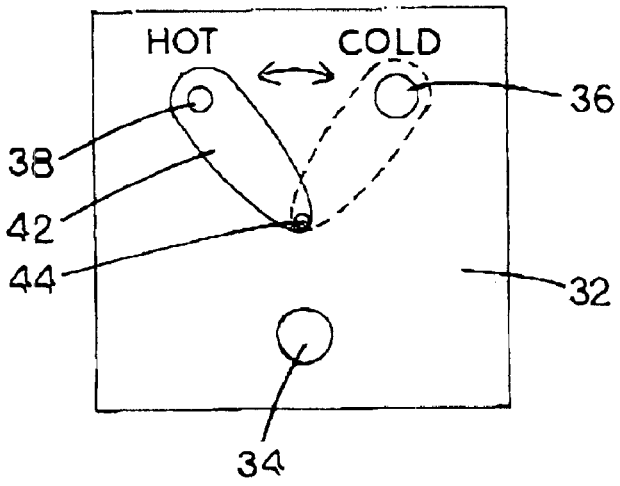
FIG. 6 is an isolated front view of the manifold and an orifice selector.

An alternate embodiment of the present invention is shown in FIGS. 5 and 6. The alternate embodiment of the present invention can work with choke valve CV (shown in FIGS. 3A and 3B) attached to actuator arm 12 for communication with the air intake of carburetor C (shown in FIGS. 2, 3A and 3B). Vacuum actuator VA is in communication with choke valve CV through actuator arm 12. A manifold 32 is in communication with vacuum actuator VA and defines at least one air inlet and one air outlet to control the amount of air entering and exiting, respectively, the system. As shown in FIG. 6, manifold 32 comprises an exhaust port 34, which can be a check valve, and manifold 32 defines air passages or orifices, such as orifices 36 and 38 of varying sizes, which are air inlets for airflow to enter the system. An orifice selector plate 42 can be attached to manifold 32 by means of a hinge 44 that allows orifice selector plate 42 to rotate over orifices 36 and 38. Orifice selector plate 42 can be positioned over and cover either of orifices 36 or 38 such that the uncovered or exposed orifice controls the amount of air entering the system. As shown in FIG. 6, if orifice selector plate 42 is positioned such that small orifice 38 is covered, more air will be allowed to enter the system through orifice 36. Conversely, if large orifice 36 is covered by orifice selector plate 42, less air will be allowed to enter the system through orifice 38. The more air that is allowed to enter the system, the quicker the vacuum will release from the system, thus allowing choke valve CV to open at a faster rate. If the engine is warm at the time of startup, less choke is needed to successfully start the engine and therefore the user would desire for choke valve CV to open at a faster rate than if the engine was cold upon starting.

Figures 7A, 7B, 7C, 7D, 7E:
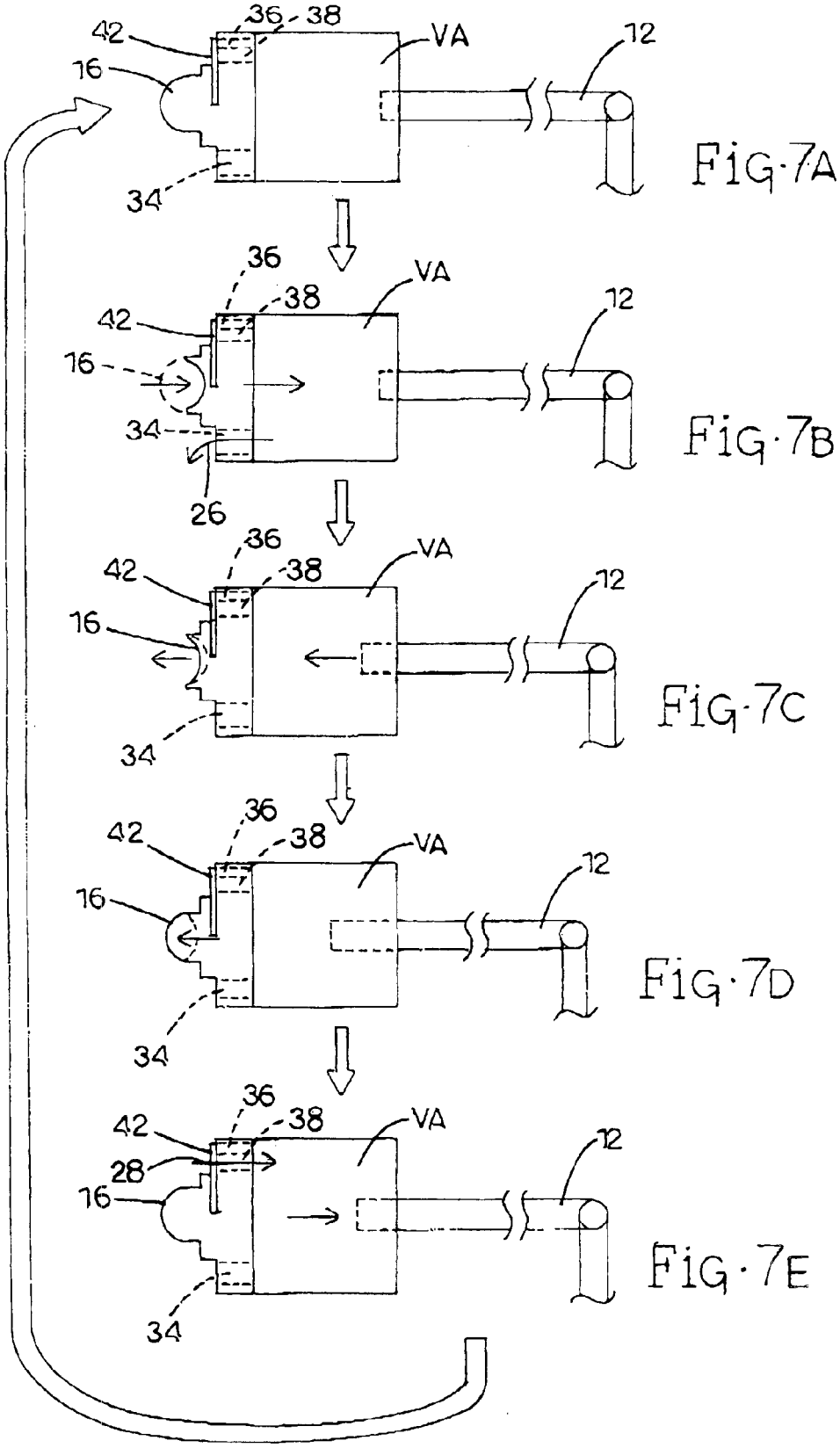
FIGS. 7A–7E are schematic diagrams illustrating operation of an embodiment of the vacuum-operated choke system utilizing a manifold.

Referring to FIGS. 7A–7E, the operation of the choke system using manifold 32 will now be described. As shown in FIG. 7A, actuator arm 12 is left in a first, open position, schematically shown as to the right in FIG. 7A, as it can be left from previous operation of the engine. To start the engine, the user will first move orifice selector plate 42 to either a "HOT" setting (covering small orifice 38) or a "COLD" setting (covering large orifice 36). As shown in FIG. 7B, the user can then operate vacuum mechanism VM, by compression of primer bulb 16, which will force air into vacuum actuator VA and out of exhaust port 34 as exiting air 26. With the excavation of air from the system, a vacuum will at least substantially be created as shown in FIG. 7C whereby vacuum actuator VA will pull actuator arm 12 towards vacuum actuator VA into its second position, thus closing choke valve CV. Once choke valve CV, through actuator arm 12, reaches a fully closed position as shown in FIG. 7D, air will enter through either small orifice 38 or large orifice 36, whichever was previously selected by the user, into the system (FIG. 7E) as entering air 28 thus gradually releasing the vacuum in a controlled fashion whereby vacuum actuator VA allows actuator arm 12 to move towards its first, open position.

If the user selected the "HOT" position on orifice selector plate 42, air will enter the system through large orifice 36 at a faster rate thus allowing choke valve CV to open at a faster rate. Conversely, if the user selected the "COLD" position on orifice selector plate 42, air will enter the system through small orifice 38 at a slower rate and choke valve CV will open at a slower rate. Once actuator arm 12 has reached its first position as shown in FIG. 7A and choke valve CV has been fully opened, choke valve CV will remain open as the engine begins to run on its own.

It will be understood that various details of the invention may be changed without departing from the scope of the invention. Furthermore, the foregoing description is for the purpose of illustration only, and not for the purpose of limitation, as the invention is defined by the claims as set forth hereinafter.

What is claimed is:

1. A choke system for use with an internal combustion engine, the choke system comprising:

(a) a vacuum actuator for moving an actuating arm from a first position to a second position, the actuating arm adapted for connection to a choke valve of an internal combustion engine;

(b) an air valve in communication with the vacuum actuator;

(c) a compressible vacuum mechanism in communication with the vacuum actuator and the air valve, the compressible vacuum mechanism being operable for compression to cause air to discharge through the air valve to create a vacuum in the vacuum actuator to move the actuating arm from the first position to the second position; and (d) whereby the air valve is operable to allow air to enter the vacuum actuator through the air valve to gradually release the vacuum to cause the vacuum actuator to move the actuating arm from the second position to the first position.

2. The choke system according to claim 1 wherein the air valve comprises an adjustable check valve.

3. The choke system according to claim 1 wherein the air valve can be used to control movement of the actuating arm from the second position to the first position over a predetermined amount of time.

4. The choke system according to claim 3 wherein the predetermined amount of time is approximately 8 to 10 seconds.

5. The choke system according to claim 1 wherein the vacuum mechanism comprises a primer bulb.

6. The choke system according to claim 1 wherein the actuating arm is connected to a choke valve such that movement of the actuating arm can open and close the choke valve.

7. The choke system according to claim 6 wherein the choke valve is unbiased.

8. The choke system according to claim 1 further comprising a manifold in communication with the vacuum actuator and wherein the manifold defines a plurality of air passages.

9. A choke system for use with an internal combustion engine, the choke system comprising:

(a) a vacuum actuator for moving an actuating arm from a first position to a second position, the actuating arm adapted for connection to a choke valve of an internal combustion engine;

(b) an air valve in communication with the vacuum actuator, wherein the air valve comprises an adjustable check valve;

(c) a compressible vacuum mechanism in communication with the vacuum actuator and the air valve, the compressible vacuum mechanism being operable for compression to cause air to discharge through the air valve to create a vacuum in the vacuum actuator to move the actuating arm from the first position to the second position; and (d) whereby the adjustable check valve is operable to allow air to enter the vacuum actuator through the air valve to gradually release the vacuum to cause the vacuum actuator to move the actuating arm from the second position to the first position over a predetermined amount of time.

10. A choke system for use with an internal combustion engine, the choke system comprising:

(a) a vacuum actuator for moving an actuating arm from a first position to a second position, the actuating arm adapted for connection to a choke valve of an internal combustion engine;

(b) a manifold in communication with the vacuum actuator, the manifold defining at least one air inlet and one air outlet communicating with the vacuum actuator for passage of air into and out of, respectively, the vacuum actuator;

(c) a compressible vacuum mechanism in communication with the vacuum actuator, the compressible vacuum mechanism being operable for compression to cause air to discharge through the air outlet to create a vacuum within the vacuum actuator to move the actuating arm from the first position to the second position; and (d) whereby air can enter the vacuum actuator through the at least one air inlet to gradually release the vacuum to cause the vacuum actuator to move the actuating arm from the second position to the first position.

11. The choke system according to claim 10 wherein the manifold defines a plurality of air inlets and further comprising an orifice selector plate attached to the manifold, wherein the orifice selector plate can be positioned to cover all of the air inlets but one to control airflow through the manifold.

12. The choke system according to claim 10 wherein the vacuum mechanism comprises a primer bulb.

13. A method for operating a choke system of an internal combustion engine comprising:

(a) providing a vacuum-operated choke system comprising:

(i) a vacuum actuator for moving an actuating arm from a first position to a second position, the actuating arm adapted for connection to a choke valve of an internal combustion engine;

(ii) an air valve in communication with the vacuum actuator; and (iii) a compressible vacuum mechanism in communication with the vacuum actuator and the air valve;

(b) operating the compressible vacuum mechanism to cause air to discharge through the air valve to create a vacuum in the vacuum actuator to move the actuating arm from the first position to the second position; and (c) controllably allowing air to enter the vacuum actuator through the air valve to gradually release the vacuum such that the vacuum actuator moves the actuating arm from the second position to the first position.

14. The method of claim 13 wherein the air valve is set to controllably allow air to enter the air valve such that movement of the actuating arm from the second position to the first position requires a predetermined amount of time.

15. A method for operating a choke system of an internal combustion engine comprising:

(a) operating a compressible vacuum mechanism to force air out of an air valve communicating with a vacuum actuator to at least substantially create a vacuum within the vacuum actuator;

(b) moving an actuating arm connected to the vacuum actuator from a first position to a second position due to the vacuum in the vacuum actuator; and (c) controllably allowing air to enter the vacuum actuator through the air valve to gradually release the vacuum such that the vacuum actuator moves the actuating arm from the second position to the first position.

16. A method for operating a choke system of an internal combustion engine comprising:

(a) providing a vacuum-operated choke system comprising:

(i) a vacuum actuator for moving an actuating from a first position to a second position, the actuating arm being adapted for connection to a choke valve of an internal combustion engine;

(ii) a manifold in communication with the vacuum actuator, the manifold defining at least one air inlet and one air outlet communicating with the vacuum actuator for passage of air into and out of, respectively, the vacuum actuator; and (iii) a compressible vacuum mechanism in communication with the vacuum actuator;

(b) operating the compressible vacuum mechanism to cause air to discharge through the air outlet to create a vacuum in the vacuum actuator to move the actuating arm from the first position to the second position; and (c) controllably allowing air to enter the vacuum actuator through the at least one air inlet to gradually release the vacuum such that the vacuum actuator moves the actuating arm from the second position to the first position.

17. A choke system for use with an internal combustion engine, the choke system comprising:

(a) a vacuum actuator for moving an actuating arm from a first position to a second position, the actuating arm connected to a choke valve of an internal combustion engine;

(b) a manifold in communication with the vacuum actuator, the manifold defining a plurality of air inlets and one air outlet communicating with the vacuum actuator for passage of air into and out of, respectively, the vacuum actuator and further comprising an orifice selector plate attached to the manifold, wherein the orifice selector plate can be positioned to cover all of the air inlets but one to control airflow through the manifold:

(c) a vacuum mechanism in communication with the vacuum actuator for forcing air out of the air outlet to at least substantially create a vacuum within the vacuum actuator; and (d) whereby creation of the vacuum within the vacuum actuator can move the actuating arm from the first position to the second position and whereby air can enter the air inlet whereby the vacuum actuator can move the actuating arm from the second position to the first position.

* * * * *